US009254986B2

(12) United States Patent
Inoue

(10) Patent No.: US 9,254,986 B2
(45) Date of Patent: Feb. 9, 2016

(54) PASSENGER CONVEYOR

(75) Inventor: Akihiko Inoue, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 14/398,558

(22) PCT Filed: Jun. 21, 2012

(86) PCT No.: PCT/JP2012/065846

§ 371 (c)(1),
(2), (4) Date: Nov. 3, 2014

(87) PCT Pub. No.: WO2013/190675

PCT Pub. Date: Dec. 27, 2013

(65) Prior Publication Data

US 2015/0090557 A1 Apr. 2, 2015

(51) Int. Cl.
*B66B 23/00* (2006.01)
*B66B 21/02* (2006.01)

(52) U.S. Cl.
CPC ..... *B66B 23/00* (2013.01); *B66B 21/02* (2013.01)

(58) Field of Classification Search
CPC ..... B66B 23/00; B66B 21/02
See application file for complete search history.

(56) References Cited

U.S. PATENT DOCUMENTS

| | | | | | |
|---|---|---|---|---|---|
| 4,260,318 | A * | 4/1981 | Holritz | B66B 21/02 254/3 R |
| 6,129,198 | A * | 10/2000 | Nusime | B66B 23/00 198/321 |
| 6,637,580 | B1 * | 10/2003 | Sneed | B65G 21/00 198/326 |
| 7,426,989 | B2 * | 9/2008 | Krampl | B66B 23/00 198/321 |

FOREIGN PATENT DOCUMENTS

| | | | | |
|---|---|---|---|---|
| JP | 61-243792 | A | 10/1986 | |
| JP | 63-17786 | A | 1/1988 | |
| JP | 2011-063389 | * | 3/2011 | B66B 23/00 |
| JP | 2011-063389 | A | 3/2011 | |
| JP | 2011-063390 | A | 3/2011 | |
| JP | 2012-66937 | | 4/2012 | |

OTHER PUBLICATIONS

International Search Report issued Aug. 7, 2012 in PCT/JP2012/065846 filed Jun. 21, 2012.
Office Action issued Aug. 25, 2015 in Chinese Patent Application No. 201280074113.5 (with English translation).

* cited by examiner

*Primary Examiner* — Gene Crawford
*Assistant Examiner* — Thomas Randazzo
(74) *Attorney, Agent, or Firm* — Oblon, McClelland, Maier & Neustadt, L.L.P.

(57) ABSTRACT

In a passenger conveyor, a supporting angle that is supported on a building beam is fixed to an end portion of a truss main body. A plurality of movement limiting members that come into contact with the supporting angle to limit horizontal movement of the supporting angle are disposed on the building beam. The supporting angle includes: a first supporting portion; and a pair of second supporting portions that are disposed on two sides of the first supporting portion in a width direction of the truss. A horizontal protruding dimension of the first supporting portion from the truss main body is different than horizontal protruding dimensions of the second supporting portions from the truss main body.

4 Claims, 11 Drawing Sheets

PASSENGER CONVEYOR

TECHNICAL FIELD

The present invention relates to a passenger conveyor in which a conveying body that conveys passengers is supported on a truss, and in which an end portion of the truss is supported on a structural beam.

BACKGROUND ART

In conventional passenger conveyors, steps and handrails are supported by a truss. The truss has: a truss main body; a movable-end supporting angle that has an L-shaped cross section that is fixed to a first longitudinal end portion of the truss main body; and a fixed-end supporting angle that has an L-shaped cross section that is fixed to a second longitudinal end portion of the truss main body. These supporting angles are respectively supported on building beams by means of height adjusting spacers.

The fixed-end supporting angle is fixed so as not to move horizontally relative to the building beams. The movable-end supporting angle, on the other hand, is supported so as to be able to slide horizontally relative to the building beams, and is thereby able to cope with building deformation. Moreover, movement of the movable-end supporting angle in a width direction of the truss is limited, thereby preventing building damage due to movement of the truss in the width direction.

In addition, known examples of constructions that limit horizontal movement of the movable-end supporting angle include constructions in which a pin that is fixed to a building beam by welding, etc., is engaged in a slot (or a notch) that is disposed on the movable-end supporting angle, and constructions in which a limiting device is installed outside the movable-end supporting angle in the width direction (See Patent Literature 1 through 3, for example).

CITATION LIST

Patent Literature

[Patent Literature 1]
Japanese Patent Laid-Open No. 2011-63389 (Gazette)
[Patent Literature 2]
Japanese Patent Laid-Open No. 2011-63390 (Gazette)
[Patent Literature 3]
Japanese Patent Laid-Open No. SHO 61-243792 (Gazette)

SUMMARY OF THE INVENTION

Problem to be Solved by the Invention

In conventional passenger conveyors such as those described above, because each of the supporting angles is constituted by a single member, the mass of each of the supporting angles is heavy, making transportability and workability when fixing the supporting angles onto the truss main body low. Furthermore, because the thickness of the movable-end supporting angle is normally around 20 mm, it has been time-consuming to dispose the slots (or the notches) on the movable-end supporting angle. In addition, working out dimensions when welding the pin to the building beam has been difficult, and machining of the pin itself has also been difficult. Furthermore, if the limiting device is installed outside the movable-end supporting angle in the radial direction, then installation width dimensions of the entire passenger conveyor are enlarged. Installation of the limiting device has also been difficult when a plurality of passenger conveyors are installed side by side in the width direction.

The present invention aims to solve the above problems and an object of the present invention is to provide a passenger conveyor that can facilitate fixing of a supporting angle onto a truss main body, and in which a movement limiting member that limits horizontal movement of the supporting angle can be easily installed without enlarging width dimensions.

Means for Solving the Problem

In order to achieve the above object, according to one aspect of the present invention, there is provided a passenger conveyor including: a truss that includes: a truss main body; and a supporting angle that is fixed to an end portion of the truss main body, and that is supported on a building beam; a conveying body that is supported by the truss, and that conveys passengers by moving cyclically; and a plurality of movement limiting members that are disposed on the building beam, and that come into contact with the supporting angle to limit horizontal movement of the supporting angle, wherein: the supporting angle includes: a first supporting portion; and a pair of second supporting portions that are disposed on two sides of the first supporting portion in a width direction of the truss; and a horizontal protruding dimension of the first supporting portion from the truss main body is different than horizontal protruding dimensions of the second supporting portions from the truss main body.

EFFECTS OF THE INVENTION

In a passenger conveyor according to the present invention, because the supporting angle has a first supporting portion and a pair of second supporting portions, and the horizontal protruding dimensions of the first supporting portion from the truss main body are different than the horizontal protruding dimensions of the second supporting portions from the truss main body, the supporting angle is reduced in weight, enabling fixing of the supporting angle to the truss main body to be facilitated. The difference between the horizontal protruding dimensions of the first and second supporting portions can also be used to place the movement limiting members in contact with the supporting angle within a range of the width dimension of the supporting angle, thereby enabling installation of the movement limiting members to be facilitated without enlarging width dimensions.

DESCRIPTION OF EMBODIMENTS

Preferred embodiments of the present invention will now be explained with reference to the drawings.

Embodiment 1

Figure 1:
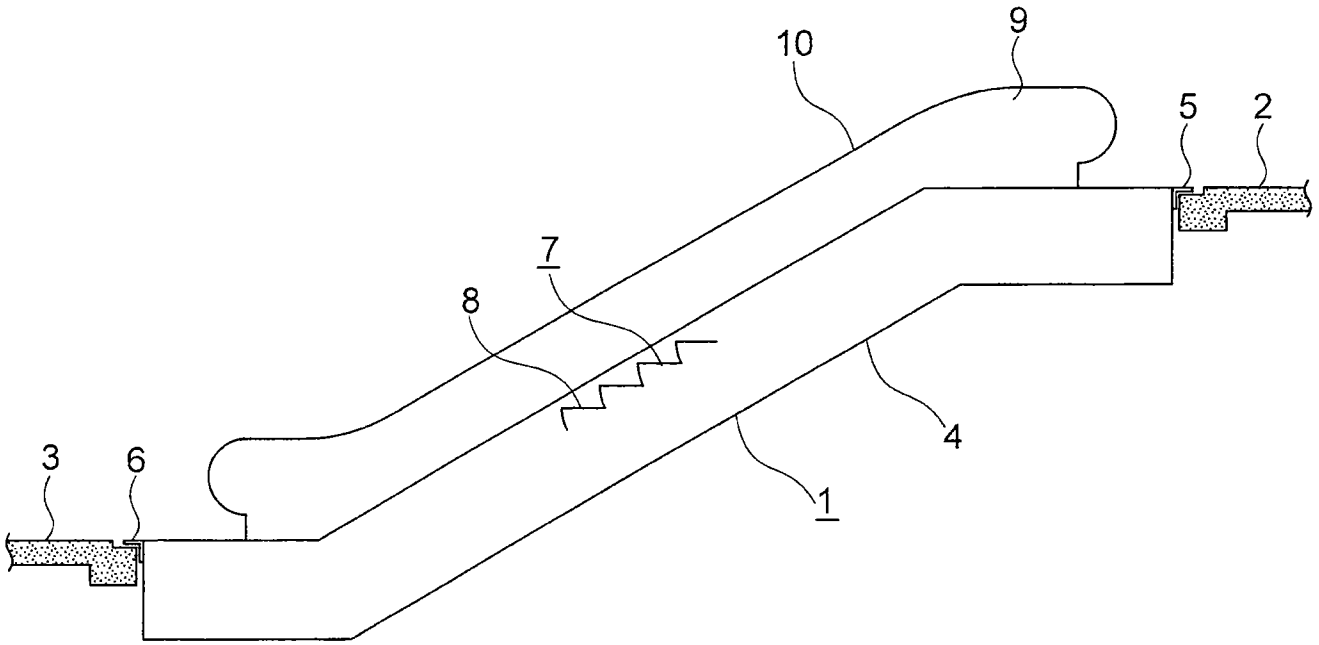
FIG. 1 is a schematic configuration diagram that shows an escalator according to Embodiment 1 of the present invention.

FIG. 1 is a schematic configuration diagram that shows an escalator according to Embodiment 1 of the present invention. In the figure, a truss 1 is disposed so as to span between an upper floor building beam 2 and a lower floor building beam 3. The truss 1 has: a truss main body 4; a movable-end supporting angle 5 that has an L-shaped cross section that is fixed horizontally onto a first longitudinal end portion (an upper floor end portion) of the truss main body 4; and a fixed-end supporting angle 6 that has an L-shaped cross section that is fixed horizontally onto a second longitudinal end portion (a lower floor end portion) of the truss main body 4.

The movable-end supporting angle 5 is supported on the upper floor building beam 2 so as to be slidable horizontally. However, movement of the movable-end supporting angle 5 in a width direction of the truss 1 is restricted. The fixed-end supporting angle 6 is fixed to the lower floor building beam 3 so as not to move horizontally.

A step linking body 7 (only a portion is shown in the figure) that functions as a conveying body that conveys passengers by moving cyclically is supported inside the truss main body 4. The step linking body 7 is configured by linking a plurality of steps 8 endlessly. The steps 8 are connected by a pair of endless step chains (not shown) that are disposed on two sides in the width direction.

A pair of driving sprocket wheels (not shown) and a driving machine (not shown) that rotates the driving sprocket wheels are installed in a vicinity of an end portion of the truss 1 near the upper floor. A pair of driven sprocket wheels (not shown) are installed in a vicinity of an end portion of the truss 1 near the lower floor. The step chains are wound onto the driving sprocket wheels and the driven sprocket wheels.

The step linking body 7 is moved cyclically by the driving sprocket wheels being rotated by the driving machine. A plurality of rails (not shown) that guide the movement of the steps 8 are disposed inside the truss 1.

A pair of railings 9 are disposed so as to stand on the truss 1 on two sides of the step linking body 7. An endless moving handrail 10 that is moved cyclically synchronously with the step linking body 7 is disposed on each of the railings 9.

Figure 2:
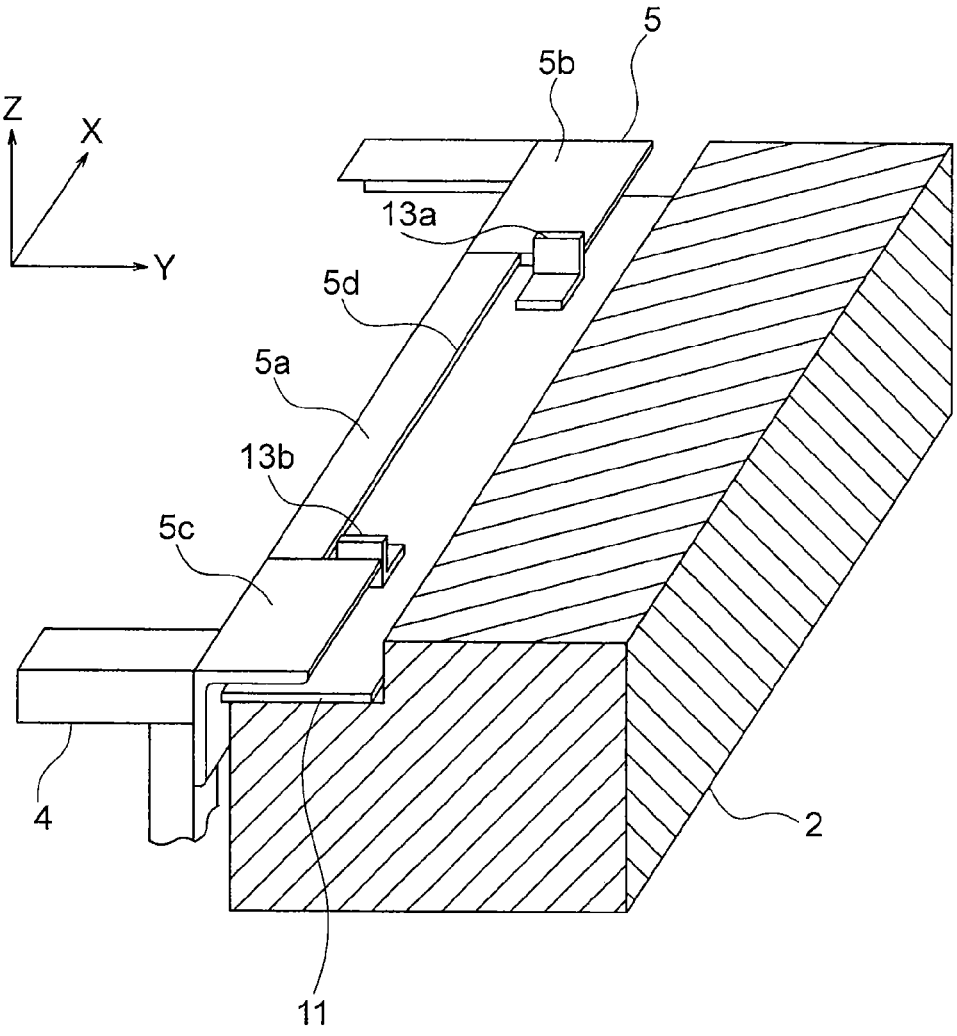
FIG. 2 is an oblique projection that shows a movable-end supporting angle from FIG. 1.
Figure 3:
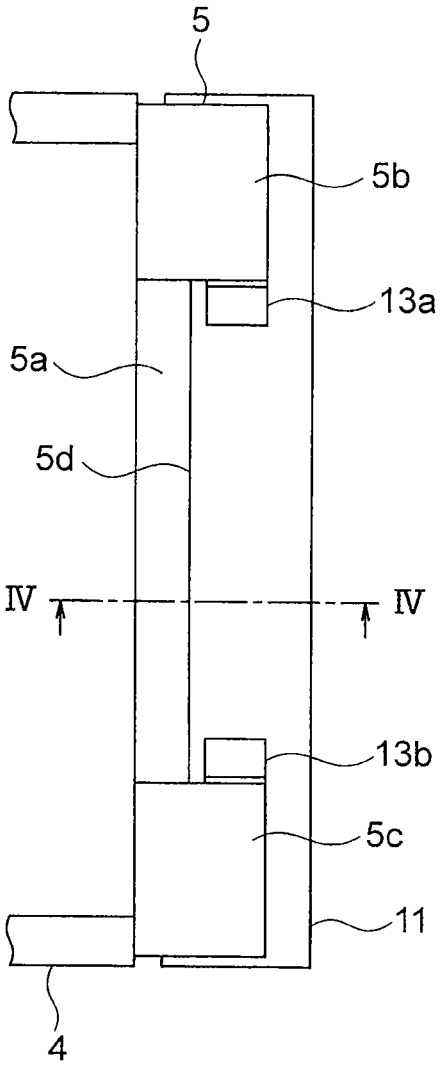
FIG. 3 is a plan that shows the movable-end supporting angle from FIG. 2.
Figure 4:
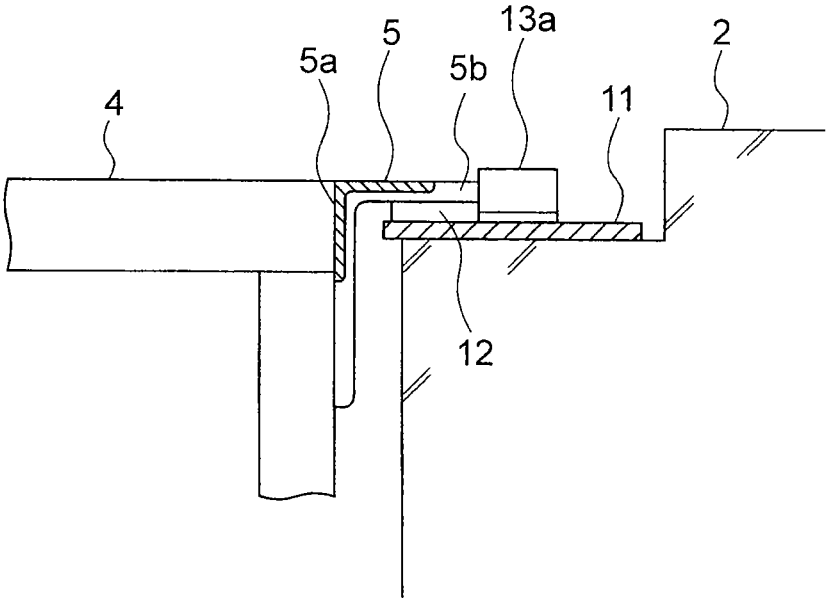
FIG. 4 is a cross section that is taken along line IV-IV in FIG. 3.

FIG. 2 is an oblique projection that shows a movable-end supporting angle 5 from FIG. 1, an X-axis direction in the figure being a width direction of the truss 1, and a Y-axis direction being the longitudinal axes of the truss 1. FIG. 3 is a plan that shows the movable-end supporting angle 5 from FIG. 2, and FIG. 4 is a cross section that is taken along line IV-IV in FIG. 3.

The movable-end supporting angle 5 is divided into three portions in the width direction of the truss 1. Thus, the movable-end supporting angle 5 has: a first supporting portion 5*a* that is positioned at an intermediate portion in the width direction of the truss 1; and a pair of second supporting portions 5*b* and 5*c* that are adjacent to two sides of the first supporting portion 5*a* in the width direction of the truss 1.

Two end portions of the first supporting portion 5*a* are fixed by being welded onto the second supporting portions 5*b* and 5*c*. In other words, the movable-end supporting angle 5 is configured by linking a pair of angle members that constitute the second supporting portions 5*b* and 5*c* using an angle member that constitutes the first supporting portion 5*a*. Furthermore, the cross-sectional area of the angle member that constitutes the first supporting portion 5*a* is less than the cross-sectional area of the angle members that constitute the second supporting portions 5*b* and 5*c*.

A horizontal protruding dimension of the first supporting portion 5*a* from the truss main body 4 is less than horizontal protruding dimensions of the second supporting portions 5*b* and 5*c* from the truss main body 4. Thus, a rectangular recess portion 5*d* is formed on an intermediate portion of the movable-end supporting angle 5 in the width direction on an opposite side from the truss main body 4 when viewed from directly above.

An upper floor backing plate 11 is fixed to the upper floor building beam 2. Horizontal portions of the second supporting portions 5*b* and 5*c* are mounted onto the upper floor backing plate 11 so as to have a pair of spacers 12 (FIG. 4) interposed. The amount of overlap of the second supporting portions 5*b* and 5*c* with the upper floor backing plate 11 is larger than the amount of overlap of the first supporting portion 5*a* with the upper floor backing plate 11.

A pair of width direction movement limiting members 13*a* and 13*b* that have L-shaped cross sections are fixed onto the upper floor backing plate 11. The width direction movement limiting members 13*a* and 13*b* are disposed inside the recess portion 5*d* when viewed from directly above.

The width direction movement limiting members 13*a* and 13*b* limit (restrict) movement of the movable-end supporting angle 5 in the width direction of the truss 1 due to earthquakes, etc., by coming into contact with end surfaces of the second supporting portions 5*b* and 5*c* that face each other, i.e., side surfaces of the recess portion 5*d* that face each other. However, movement of the movable-end supporting angle 5 is permitted in the longitudinal direction of the truss 1.

In addition, the width direction movement limiting members 13*a* and 13*b* are welded onto the upper floor backing plate 11 during installation of the escalator.

Figure 5:
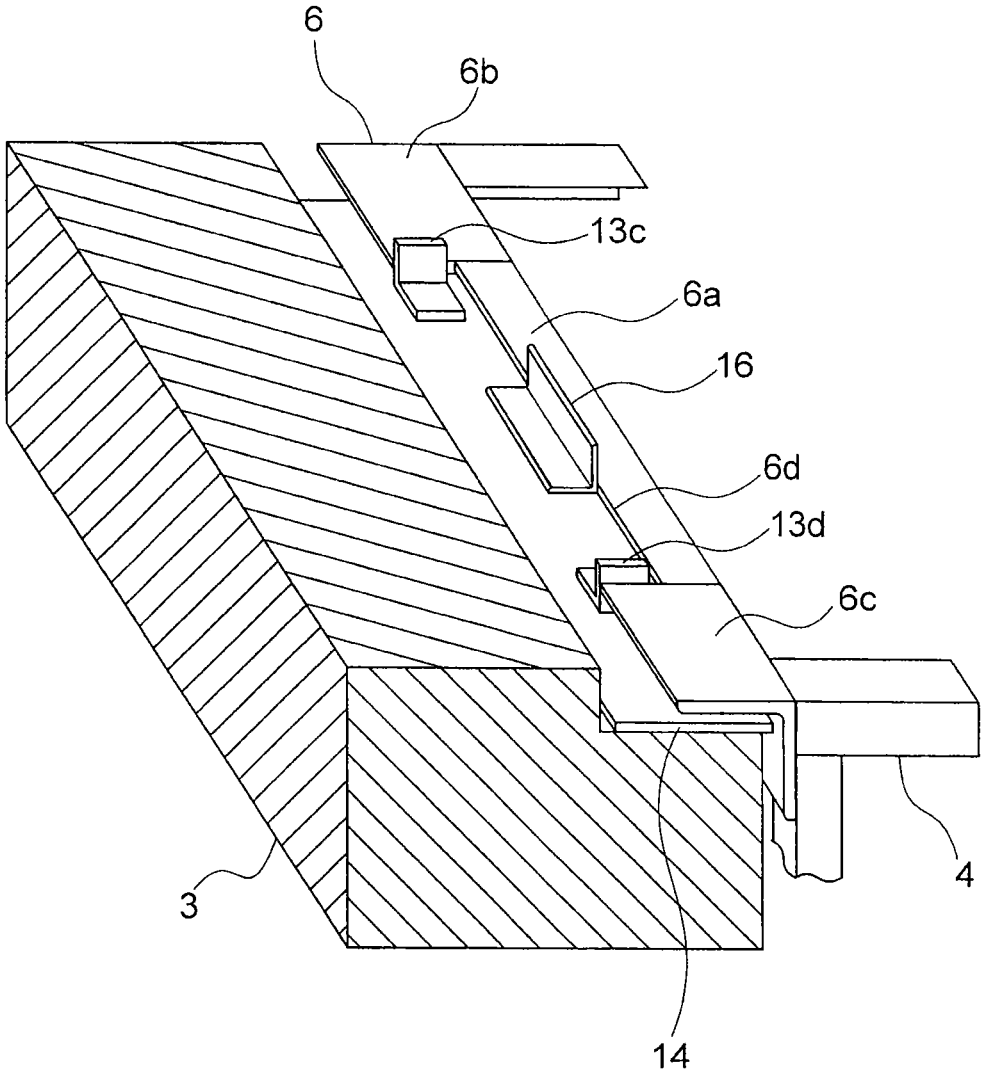
FIG. 5 is an oblique projection that shows a fixed-end supporting angle from FIG. 1.
Figure 6:
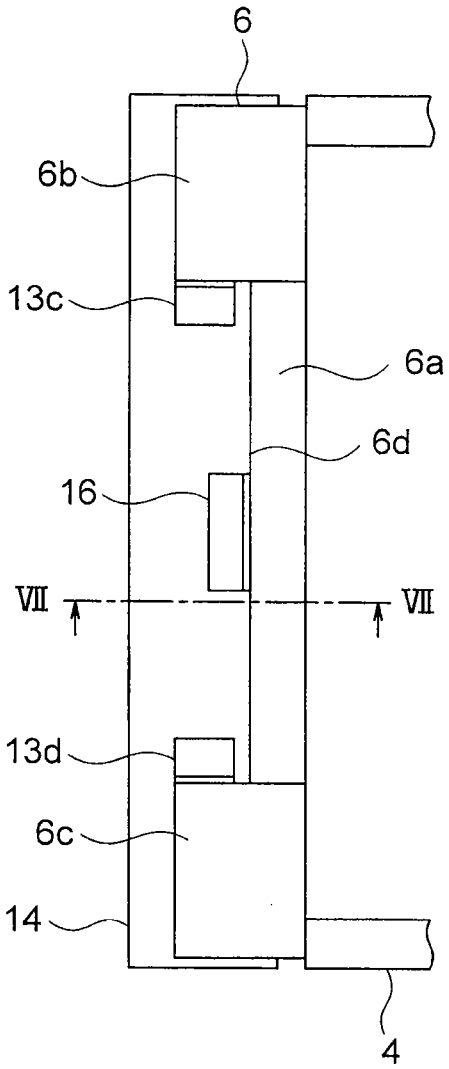
FIG. 6 is a plan that shows a fixed-end supporting angle from FIG. 5.
Figure 7:
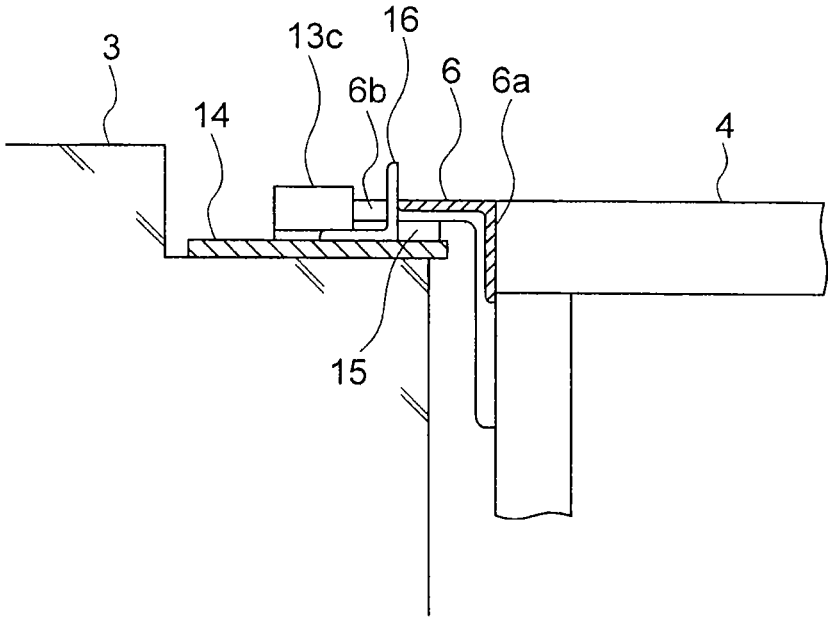
FIG. 7 is a cross section that is taken along line VII-VII in FIG. 6.

FIG. 5 is an oblique projection that shows the fixed-end supporting angle 6 from FIG. 1, FIG. 6 is a plan that shows the fixed-end supporting angle 6 from FIG. 5, and FIG. 7 is a cross section that is taken along line VII-VII in FIG. 6.

The fixed-end supporting angle 6 is divided into three portions in the width direction of the truss 1. Thus, the fixed-end supporting angle 6 has: a first supporting portion 6*a* that is positioned at an intermediate portion in the width direction of the truss 1; and a pair of second supporting portions 6*b* and 6*c* that are adjacent to two sides of the first supporting portion 6*a* in the width direction of the truss 1.

Two end portions of the first supporting portion 6*a* are fixed by being welded onto the second supporting portions 6*b* and 6*c*. In other words, the fixed-end supporting angle 6 is configured by linking a pair of angle members that constitute the second supporting portions 6*b* and 6*c* using an angle member that constitutes the first supporting portion 6*a*. Furthermore, the cross-sectional area of the angle member that constitutes the first supporting portion 6*a* is less than the cross-sectional area of the angle members that constitute the second supporting portions 6*b* and 6*c*.

A horizontal protruding dimension of the first supporting portion 6*a* from the truss main body 4 is less than horizontal protruding dimensions of the second supporting portions 6*b* and 6*c* from the truss main body 4. Thus, a rectangular recess portion 6*d* is formed on an intermediate portion of the fixed-end supporting angle 6 in the width direction on an opposite side from the truss main body 4 when viewed from directly above. Thus, the configuration of the fixed-end supporting angle 6 is identical to the configuration of the movable-end supporting angle 5.

A lower floor backing plate 14 is fixed to the lower floor building beam 3. Horizontal portions of the second supporting portions 6*b* and 6*c* are mounted onto the lower floor backing plate 14 so as to have a pair of spacers 15 (FIG. 7) interposed. The amount of overlap of the second supporting portions 6*b* and 6*c* with the lower floor backing plate 14 is larger than the amount of overlap of the first supporting portion 6*a* with the lower floor backing plate 14.

A pair of width direction movement limiting members 13*c* and 13*d* that have L-shaped cross sections and a longitudinal movement limiting member 16 that has an L-shaped cross section are fixed onto the lower floor backing plate 14. The width direction movement limiting members 13*c* and 13*d* and the longitudinal movement limiting member 16 are disposed inside the recess portion 6*d* when viewed from directly above.

The width direction movement limiting members 13*c* and 13*d* are placed in contact with end surfaces of the second supporting portions 6*b* and 6*c* that face each other, i.e., side surfaces of the recess portion 6*d* that face each other. The second supporting portions 6*b* and 6*c* are fixed by being welded onto the width direction movement limiting members 13*c* and 13*d*.

The longitudinal movement limiting member 16 is placed in contact with an end surface of the first supporting portion 6*a*, i.e., a bottom surface of the recess portion 6*d*. The first supporting portion 6*a* is fixed by being welded onto the longitudinal movement limiting member 16.

In addition, the width direction movement limiting members 13*c* and 13*d* and the longitudinal movement limiting member 16 are welded onto the lower floor backing plate 14, and are also welded to the fixed-end supporting angle 6, during installation of the escalator.

In an escalator of this kind, because the movable-end supporting angle 5 has a first supporting portion 5*a* and second supporting portions 5*b* and 5*c*, and the fixed-end supporting angle 6 has a first supporting portion 6*a* and second supporting portions 6*b* and 6*c*, and the horizontal protruding dimensions of the first supporting portions 5*a* and 6*a* from the truss main body 4 are different than the horizontal protruding dimensions of the second supporting portions 5*b*, 5*c*, 6*b*, and 6*c* from the truss main body 4, the supporting angles 5 and 6 are reduced in weight, enabling fixing of the supporting angles 5 and 6 onto the truss main body 4 to be facilitated.

The difference between the horizontal protruding dimensions of the first and second supporting portions 5*a*, 6*a*, 5*b*, 5*c*, 6*b*, and 6*c* can also be used to place the movement limiting members 13*a* through 13*d*, and 16 in contact with the supporting angles 5 and 6 within a range of (inside) the width dimensions of the supporting angles 5 and 6, thereby enabling installation of the movement limiting members 13*a* through 13*d*, and 16 to be facilitated without enlarging the width dimensions.

In addition, because recess portions 5*d* and 6*d* are formed on the supporting angles 5 and 6, and the movement limiting members 13*a* through 13*d*, and 16 are disposed inside the recess portions 5*d* and 6*d*, the movement limiting members 13*a* through 13*d*, and 16 are disposed within a range of the width dimensions of the supporting angles 5 and 6 efficiently while supporting the truss 1 stably on the building beams 2 and 3.

Furthermore, because the supporting angles 5 and 6 are configured by combining angle members that have different cross-sectional areas, the supporting angles 5 and 6 can be easily reduced in weight by a simple configuration.

Embodiment 2

Figure 8:
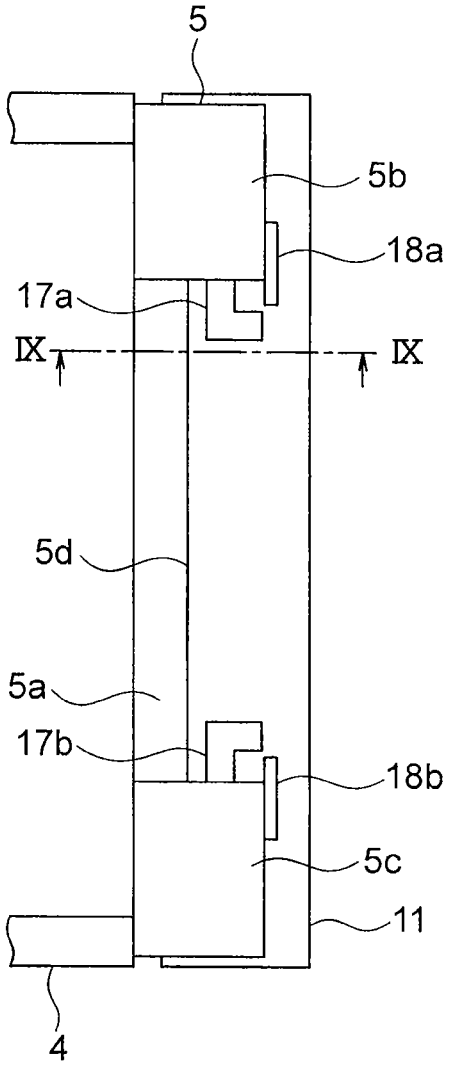
FIG. 8 is a plan that shows a movable-end supporting angle of a passenger conveyor according to Embodiment 2 of the present invention.
Figure 9:
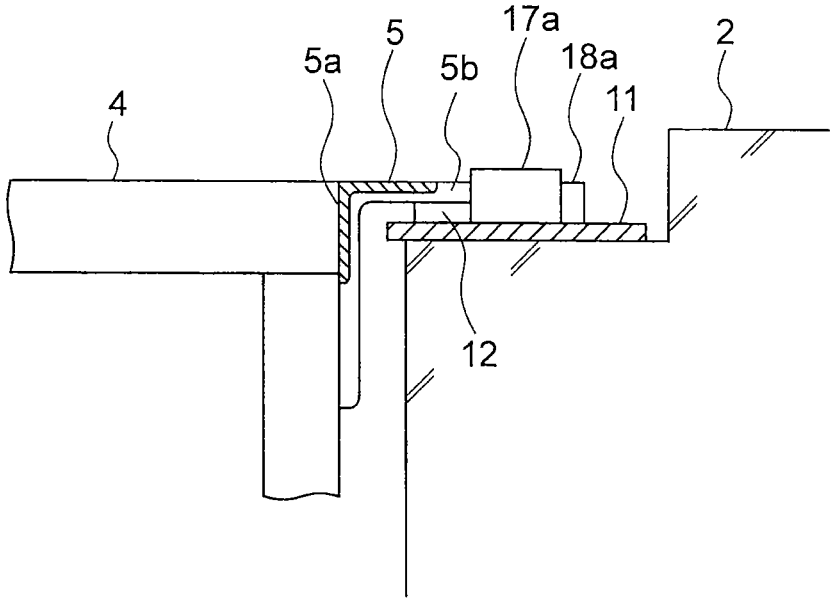
FIG. 9 is a cross section that is taken along line IX-IX in FIG. 8.

Next, FIG. 8 is a plan that shows a movable-end supporting angle 5 of a passenger conveyor according to Embodiment 2 of the present invention, and FIG. 9 is a cross section that is taken along line IX-IX in FIG. 8.

A pair of block-shaped width direction movement limiting members 17*a* and 17*b* that have L-shaped horizontal shapes are fixed onto an upper floor backing plate 11. The width direction movement limiting members 17*a* and 17*b* are disposed inside a recess portion 5*d* when viewed from directly above.

The width direction movement limiting members 17*a* and 17*b* limit (restrict) movement of a movable-end supporting angle 5 in a width direction of a truss 1 due to earthquakes, etc., by coming into contact with end surfaces of second supporting portions 5*b* and 5*c* that face each other, i.e., side surfaces of the recess portion 5*d* that face each other. However, movement of the movable-end supporting angle 5 is permitted in a longitudinal direction of the truss 1.

In addition, the width direction movement limiting members 17*a* and 17*b* are welded onto the upper floor backing plate 11 during installation of the escalator.

Flat stoppers 18*a* and 18*b* are fixed by welding, etc., onto end surfaces of the second supporting portions 5*b* and 5*c* on opposite sides from a truss main body 4. The stoppers 18*a* and 18*b* limit movement of the movable-end supporting angle 5 in a direction in which the truss main body 4 moves away from the upper floor building beam 2 to within a predetermined range by coming into contact with the width direction movement limiting members 17*a* and 17*b*. The rest of the configuration is similar or identical to that of Embodiment 1.

In an escalator of this kind, because movement of the movable-end supporting angle 5 in the longitudinal direction of the truss 1 is limited to a predetermined range by a movable-end end portion (a first end portion) of the truss 1, the movable-end supporting angle 5 can be prevented from displacing significantly relative to the upper floor building beam 2 due to earthquakes, etc., and disengaging the truss 1 from the upper floor building beam 2.

Embodiment 3

Figure 10:
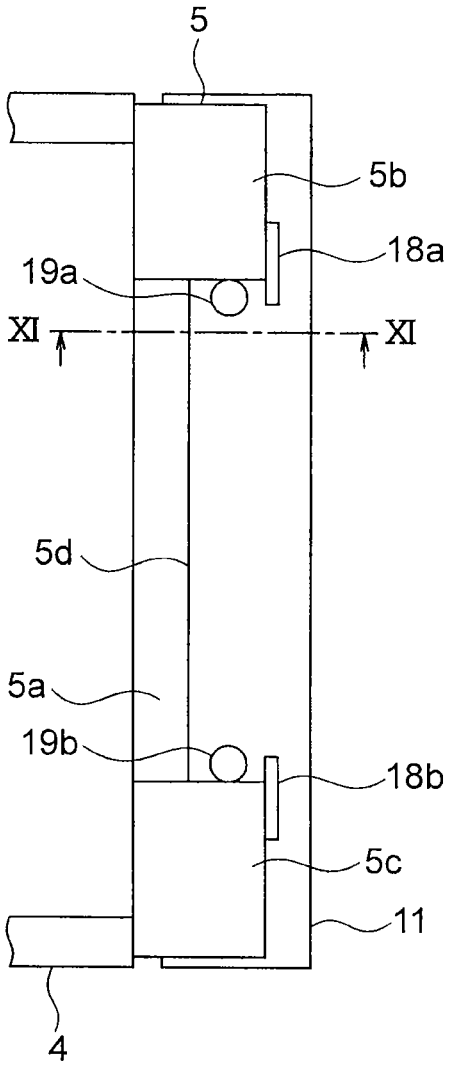
FIG. 10 is a plan that shows a movable-end supporting angle of a passenger conveyor according to Embodiment 3 of the present invention.
Figure 11:
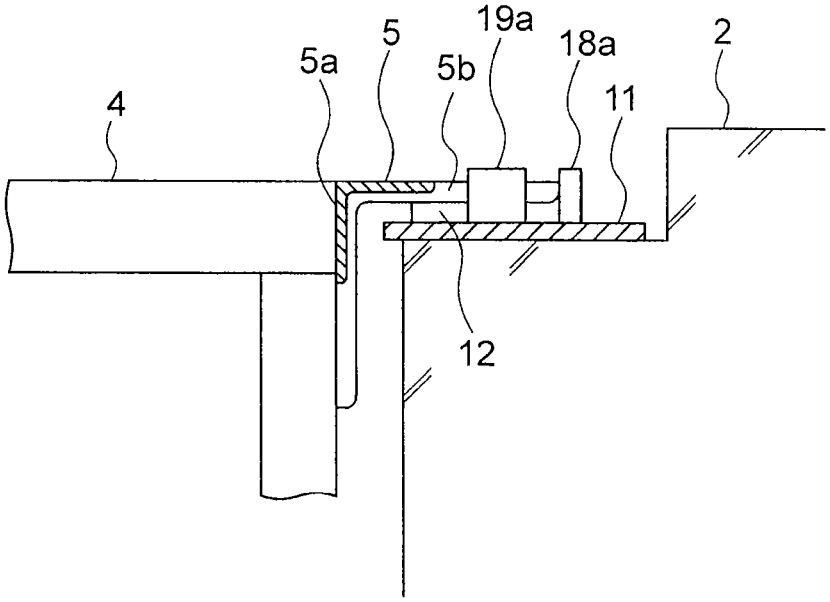
FIG. 11 is a cross section that is taken along line XI-XI in FIG. 10.

Next, FIG. 10 is a plan that shows a movable-end supporting angle 5 of a passenger conveyor according to Embodiment 3 of the present invention, and FIG. 11 is a cross section that is taken along line XI-XI in FIG. 10. In this example, a pair of round bar-shaped (cylindrical) width direction movement limiting members 19*a* and 19*b* are fixed onto an upper floor backing plate 11 instead of the width direction movement limiting members 17*a* and 17*b* according to Embodiment 2. The rest of the configuration is similar or identical to that of Embodiment 2.

Similar or identical effects to those of Embodiment 2 can also be achieved using width direction movement limiting members 19*a* and 19*b* of this kind.

Moreover, in the above examples, the horizontal protruding dimensions of the first supporting portions 5*a* and 6*a* from the truss main body 4 are made smaller than the horizontal protruding dimensions of the second supporting portions 5*b*, 5*c*, 6*b*, and 6*c* from the truss main body 4, but horizontal protruding dimensions of first supporting portions from a truss main body may be made larger than horizontal protruding dimensions of second supporting portions from a truss main body. In that case, movement limiting members are disposed on two sides in the width direction of the first supporting portions within a range of a width dimension of the truss.

The construction may be made such that a horizontal member that is parallel to the width direction is fixed to an end portion of a truss main body, and first and second supporting portions are fixed to that horizontal member. In that case, the first supporting portions and second supporting portions do not need to be linked directly, and clearance may be left between the first supporting portions and the second supporting portions.

In addition, in the above examples, the upper floor end portion of the truss 1 is the movable end, and the lower floor end portion is the fixed end, but that may also be reversed.

Furthermore, in the above examples, the present invention was applied to two end portions of the truss 1, but can instead be applied to only one of them.

In the above examples, an escalator is shown, but the present invention can also be applied to a moving walk. In that case, the moving walk may be a horizontal type, or may be an inclined type. Furthermore, the conveying body is not limited to a step linking body, and may be a belt conveyor type.

The invention claimed is:

1. A passenger conveyor comprising:

a truss that includes:

a truss main body; and a supporting angle that is fixed to an end portion of the truss main body, and that is supported on a building beam;

a conveying body that is supported by the truss, and that conveys passengers by moving cyclically; and a plurality of movement limiting members that are disposed on the building beam, and that come into contact with the supporting angle to limit horizontal movement of the supporting angle, wherein:

the supporting angle includes:

a first supporting portion; and a pair of second supporting portions that are disposed on two sides of the first supporting portion in a width direction of the truss, wherein each of the first supporting portion and the second supporting portions protrude from the truss main body to terminate at a protruding edge thereof; and a horizontal protruding dimension from the truss main body of the protruding edge of the first supporting portion from the truss main body is different than horizontal protruding dimensions from the truss main body of the protruding edges of the second supporting portions.

2. A passenger conveyor comprising:

a truss that includes:

a truss main body; and a supporting angle that is fixed to an end portion of the truss main body, and that is supported on a building beam;

a conveying body that is supported by the truss, and that conveys passengers by moving cyclically; and a plurality of movement limiting members that are disposed on the building beam, and that come into contact with the supporting angle to limit horizontal movement of the supporting angle, wherein:

the supporting angle includes:

a first supporting portion; and a pair of second supporting portions that are disposed on two sides of the first supporting portion in a width direction of the truss; and a horizontal protruding dimension of the first supporting portion from the truss main body is different than horizontal protruding dimensions of the second supporting portions from the truss main body, wherein:

the horizontal protruding dimension of the first supporting portion from the truss main body is smaller than the horizontal protruding dimensions of the second supporting portions from the truss main body, whereby a recess portion is formed at an intermediate portion of the supporting angle in the width direction on an opposite side from the truss main body; and the movement limiting members are disposed inside the recess portion.

3. A passenger conveyor comprising:

a truss that includes:

a truss main body; and a supporting angle that is fixed to an end portion of the truss main body, and that is supported on a building beam;

a conveying body that is supported by the truss, and that conveys passengers by moving cyclically; and a plurality of movement limiting members that are disposed on the building beam, and that come into contact with the supporting angle to limit horizontal movement of the supporting angle, wherein:

the supporting angle includes:

a first supporting portion; and a pair of second supporting portions that are disposed on two sides of the first supporting portion in a width direction of the truss; and a horizontal protruding dimension of the first supporting portion from the truss main body is different than horizontal protruding dimensions of the second supporting portions from the truss main body, wherein:

the supporting angle is formed such that a pair of angle members that constitute the second supporting portions are linked by an angle member that constitutes the first supporting portion; and a cross-sectional area of the angle member that constitutes the first supporting portion is different than a cross-sectional area of the angle members that constitute the second supporting portions.

4. A passenger conveyor comprising:

a truss that includes:

a truss main body; and a supporting angle that is fixed to an end portion of the truss main body, and that is supported on a building beam;

a conveying body that is supported by the truss, and that conveys passengers by moving cyclically; and a plurality of movement limiting members that are disposed on the building beam, and that come into contact with the supporting angle to limit horizontal movement of the supporting angle, wherein:

the supporting angle includes:

a first supporting portion; and a pair of second supporting portions that are disposed on two sides of the first supporting portion in a width direction of the truss; and a horizontal protruding dimension of the first supporting portion from the truss main body is different than horizontal protruding dimensions of the second supporting portions from the truss main body, further comprising a stopper that is disposed on the supporting angle so as to limit movement of the supporting angle in a direction in which the truss main body moves away from the building beam to within a predetermined range by coming into contact with the movement limiting members.

* * * * *